US009027801B2

(12) United States Patent
Sällström et al.

(10) Patent No.: US 9,027,801 B2
(45) **Date of Patent: *May 12, 2015**

(54) FEEDER ELEMENT

(71) Applicant: Foseco International Limited, Derbyshire (GB)

(72) Inventors: Jan Sällström, Gunnarskog (SE); Paul David Jeffs, Warwickshire (GB)

(73) Assignee: Foseco International Limited, Derbyshire (GB)

( * ) Notice: Subject to any disclaimer, the term of this patent is extended or adjusted under 35 U.S.C. 154(b) by 373 days.

This patent is subject to a terminal disclaimer.

(21) Appl. No.: 13/705,352

(22) Filed: Dec. 5, 2012

(65) Prior Publication Data

US 2013/0306685 A1 Nov. 21, 2013

(30) Foreign Application Priority Data

May 15, 2012 (EP) ..... 12250107

(51) Int. Cl.
*B22D 35/04* (2006.01)
*B22C 9/08* (2006.01)

(52) U.S. Cl.
CPC ..... *B22D 35/04* (2013.01); *B22C 9/084* (2013.01); *B22C 9/088* (2013.01)

(58) Field of Classification Search
CPC .... B22D 11/00; B22D 11/041; B22D 11/043; B22D 11/04; B22D 41/13; B22D 41/50; B22D 35/04; B22C 9/084; B22C 9/088
USPC ..... 222/591; 164/359, 360
See application file for complete search history.

(56) References Cited

U.S. PATENT DOCUMENTS

| | | | | |
|---|---|---|---|---|
| 7,500,509 | B2 * | 3/2009 | Powell et al. | 164/359 |
| 8,430,150 | B2 * | 4/2013 | Sallstrom et al. | 164/359 |
| 2009/0014482 | A1 * | 1/2009 | Tackaberry et al. | 222/591 |

FOREIGN PATENT DOCUMENTS

| | | | |
|---|---|---|---|
| DE | 20 004009 367 | U1 | 8/2004 |
| DE | 202004021109 | U1 | 9/2006 |

(Continued)

OTHER PUBLICATIONS

Extended European Search Report; Application No. EP 12250107.5-2122, 7 pgs, dated Oct. 16, 2012.

(Continued)

*Primary Examiner* — Scott Kastler
*Assistant Examiner* — Michael Aboagye
(74) *Attorney, Agent, or Firm* — Nixon & Vanderhye P.C.

(57) ABSTRACT

An elongate collapsible feeder element for use in metal casting and a feeder system with attached feeder element and feeder sleeve. The feeder element has an A end and an opposite B end measured along the height, and a C end and an opposite D end measured along the length. The A end is for mounting on a mold pattern or swing plate and the opposite B end is for receiving a feeder sleeve. A bore is between the A and B ends defined by a sidewall having a stepped collapsible portion. The feeder element is compressible in use to reduce the distance between the A and B ends. The bore is offset from the centre of the feeder element along the length towards the C end and a second sidewall region is non-planar, contiguous with a third sidewall region and located between the bore axis and the D end.

24 Claims, 9 Drawing Sheets

(56) References Cited

FOREIGN PATENT DOCUMENTS

| | | | |
|---|---|---|---|
| EP | 1 184 104 | A1 | 7/2001 |
| EP | 1 184 104 | B1 | 12/2004 |
| EP | 1 567 294 | B1 | 5/2006 |
| EP | 1 879 710 | B1 | 3/2009 |
| EP | 1 732 719 | B1 | 7/2009 |
| EP | 2 489 450 | A1 | 8/2012 |
| WO | WO 2005/051568 | A1 | 6/2005 |
| WO | WO 2007/141466 | A1 | 12/2007 |

OTHER PUBLICATIONS

Specification of Co-pending U.S. Appl. No. 13/309,700, filed Dec. 2, 2011 (36 pgs).

Specification of Co-pending U.S. Appl. No. 29/430,164, filed Aug. 22, 2012 (8 pgs).

* cited by examiner

FEEDER ELEMENT

FIELD OF THE INVENTION

The present invention relates to a feeder element for use in metal casting operations utilising casting moulds, especially but not exclusively in high pressure vertically parted sand moulding systems.

BACKGROUND

In a typical casting process, molten metal is poured into a pre-formed mould cavity which defines the shape of the casting. However, as the metal solidifies it shrinks, resulting in shrinkage cavities which in turn result in unacceptable imperfections in the final casting. This is a well known problem in the casting industry and is addressed by the use of feeder sleeves or risers which are integrated into the mould during mould formation. Each feeder sleeve provides an additional (usually enclosed) volume or cavity which is in communication with the mould cavity, so that molten metal also enters into the feeder sleeve. During solidification, molten metal within the feeder sleeve flows back into the mould cavity to compensate for the shrinkage of the casting. It is important that metal in the feeder sleeve cavity remains molten longer than the metal in the mould cavity, so feeder sleeves are made to be highly insulating or more usually exothermic, so that upon contact with the molten metal additional heat is generated to delay solidification.

After solidification and removal of the mould material, unwanted residual metal from within the feeder sleeve cavity remains attached to the casting and must be removed. In order to facilitate removal of the residual metal, the feeder sleeve cavity may be tapered towards its base (i.e. the end of the feeder sleeve which will be closest to the mould cavity) in a design commonly referred to as a neck down sleeve. When a sharp blow is applied to the residual metal it separates at the weakest point which will be near to the casting surface (the process commonly known as "knock off"). A small footprint on the casting is also desirable to allow the positioning of feeder sleeves in areas of the casting where access may be restricted by adjacent features.

Although feeder sleeves may be applied directly onto the surface of the mould cavity, they are often used in conjunction with a breaker core. A breaker core is simply a disc of refractory material (typically a resin bonded sand core or a ceramic core or a core of feeder sleeve material) with a hole in its centre which sits between the mould cavity and the feeder sleeve. The diameter of the hole through the breaker core is designed to be smaller than the diameter of the interior cavity of the feeder sleeve (which need not necessarily be tapered) so that knock off occurs at the breaker core close to the casting surface.

Breaker cores may also be manufactured out of metal. DE 196 42 838 A1 discloses a modified feeding system in which the traditional ceramic breaker core is replaced by a rigid flat annulus and DE 201 12 425 U1 discloses a modified feeding system utilising a rigid "hat-shaped" annulus.

Casting moulds are commonly formed using a moulding pattern which defines the mould cavity. Pins are provided on the pattern plate at predetermined locations as mounting points for the feeder sleeves. Once the required sleeves are mounted on the pattern plate, the mould is formed by pouring moulding sand onto the pattern plate and around the feeder sleeves until the feeder sleeves are covered and the mould box is filled. The mould must have sufficient strength to resist erosion during the pouring of molten metal, to withstand the ferrostatic pressure exerted on the mould when full and to resist the expansion/compression forces when the metal solidifies.

Moulding sand can be classified into two main categories. Chemical bonded (based on either organic or inorganic binders) or clay-bonded. Chemically bonded moulding binders are typically self-hardening systems where a binder and a chemical hardener are mixed with the sand and the binder and hardener start to react immediately, but sufficiently slowly enough to allow the sand to be shaped around the pattern plate and then allowed to harden enough for removal and casting.

Clay-bonded moulding sand uses clay and water as the binder and can be used in the "green" or undried state and is commonly referred to as greensand. Greensand mixtures do not flow readily or move easily under compression forces alone and therefore to compact the greensand around the pattern and give the mould sufficient strength properties as detailed previously, a variety of combinations of jolting, vibrating, squeezing and ramming are applied to produce uniform strength moulds, usually at high productivity. The sand is typically compressed (compacted) at high pressure, usually using a hydraulic ram (the process being referred to as "ramming up"). With increasing casting complexity and productivity requirements, there is a need for more dimensionally stable moulds and the tendency is towards higher ramming pressures which can result in breakage of the feeder sleeve and/or breaker core when present, especially if the breaker core or the feeder sleeve is in direct contact with the pattern plate prior to ram up.

The above problem is partly alleviated by the use of spring pins. The feeder sleeve and optional locator core (typically comprised of high density sleeve material, with similar overall dimensions to breaker cores) is initially spaced from the pattern plate and moves towards the pattern plate on ram up. The spring pin and feeder sleeve may be designed such that after ramming, the final position of the sleeve is such that it is not in direct contact with the pattern plate and may be typically 5 to 25 mm distant from the pattern surface. The knock off point is often unpredictable because it is dependent upon the dimensions and profile of the base of the spring pins and therefore can result in additional cleaning costs. The solution offered in EP-A-1184104 is a two-part feeder sleeve. Under compression during mould formation, one mould (sleeve) part telescopes into the other. One of the mould (sleeve) parts is always in contact with the pattern plate and there is no requirement for a spring pin. However, there are problems associated with the telescoping arrangement of EP-A-1184104. For example, due to the telescoping action, the volume of the feeder sleeve after moulding is variable and dependent on a range of factors including moulding machine pressure, casting geometry and sand properties. This unpredictability can have a detrimental effect on feed performance. In addition, the arrangement is not ideally suited where exothermic sleeves are required. When exothermic sleeves are used, direct contact of exothermic material with the casting surface is undesirable and can result in poor surface finish, localised contamination of the casting surface and even subsurface gas defects.

Yet a further disadvantage of the telescoping arrangement of EP-A-1184104 arises from the tabs or flanges which are required to maintain the initial spacing of the two mould (sleeve) parts. During moulding, these small tabs break off (thereby permitting the telescoping action to take place) and simply fall into the moulding sand. Over a period of time, these pieces will build up in the moulding sand. The problem is particularly acute when the pieces are made from exothermic material. Moisture from the sand can potentially react with the exothermic material (e.g. metallic aluminium) creating the potential for small explosive defects.

WO2005/051568 (the entire disclosure of which is incorporated herein by reference) discloses a feeder element (a collapsible breaker core) that is especially useful in high-pressure sand moulding systems. The feeder element has a first end for mounting on a mould pattern, an opposite second end for receiving a feeder sleeve and a bore between the first and second ends defined by a stepped sidewall. The stepped sidewall is designed to deform irreversibly under a predetermined load (the crush strength). The feeder element offers numerous advantages over traditional breaker cores including:—

(i) a smaller feeder element contact area (aperture to the casting);

(ii) a small footprint (external profile contact) on the casting surface;

(iii) reduced likelihood of feeder sleeve breakage under high pressures during mould formation; and (iv) consistent knock off with significantly reduced cleaning requirements.

The feeder element of WO2005/051568 is exemplified in a high-pressure sand moulding system. The high ramming pressures involved necessitate the use of high strength (and high cost) feeder sleeves. This high strength is achieved by a combination of the design of the feeder sleeve (i.e. shape, thickness etc.) and the material (i.e. refractory materials, binder type and addition, manufacturing process etc.). The examples demonstrate the use of the feeder element with a FEEDEX HD-VS159 feeder sleeve, which is designed to be pressure resistant (i.e. high strength) and for spot feeding (i.e. high density, highly exothermic, thick-walled, and thus high modulus). The feeder sleeve is secured to the feeder element via a mounting surface which bears the weight of the feeder sleeve and which is perpendicular to the bore axis. For medium pressure moulding there is the potential opportunity of using lower strength sleeves i.e. different designs (shapes and wall thicknesses etc.) and/or different composition (i.e. lower strength). Irrespective of the sleeve design and composition, in use there would still be the issues associated with knock off from the casting (variability and size of footprint on the casting) and need for good sand compaction beneath the feeder element. If the feeder element of WO2005/051568 were to be employed in medium-pressure moulding lines it would be necessary to design the element so that it collapses sufficiently at the lower moulding pressure (as compared to high pressure moulding) i.e. to have a lower initial crush strength. It would also be highly advantageous to use lower strength feeder sleeves (typically lower density sleeves). In addition to removing the cost penalty (associated with having to use high strength high density sleeves), this would allow the use of sleeves better suited to the individual application (casting) in terms of volume and thermophysical properties. However, when this was first attempted it was surprisingly discovered that the feeder sleeve suffered damage and breakages on moulding which if used for casting would have resulted in the casting suffering from defects.

An improved feeder element was therefore devised and described in WO2007/141466 (the entire content of which is also incorporated herein by reference) to extend the utility of collapsible feeder elements into medium pressure moulding systems while allowing the use of relatively weak feeder sleeves without introducing casting defects. This feeder element is similar to that described above in relation to WO2005/051568 but further includes a first sidewall region defining the second end of the element and a mounting surface for a feeder sleeve in use, the first sidewall region being inclined to the bore axis by less than 90°, and a second sidewall region contiguous with the first sidewall region, the second sidewall region being parallel to or inclined to the bore axis at a different angle to the first sidewall region whereby to define a step in the sidewall. As for the feeder element described in WO2005/051568, it was similarly found that such an arrangement was advantageous in minimising the footprint and contact area of the feeder element, thereby reducing the variability associated with knock-off from the casting.

To satisfy productivity requirements, automated greensand moulding lines have become increasingly popular, for the high volume and long run manufacture of smaller castings, e.g. automotive components. Automated horizontally parted moulding lines using a matchplate (pattern plate with patterns for both cope and drag mounted on opposite sides) are capable of producing moulds at up to 100-150 per hour. Vertically parted moulding machines (such as Disamatic flaskless moulding machines manufactured by DISA Industries A/S), are capable of much higher rates of up to 450-500 moulds per hour. In the Disamatic machine, one pattern half is fitted onto the end of a hydraulically operated squeeze piston with the other half fitted to a swing plate, so called because of its ability to move and swing away from the mould. Vertically parted mould machines are capable of producing hard, rigid flaskless greensand moulds, which are particularly suited for ductile iron castings. In such applications, sand is typically blown at a pressure of 2 to 4 bar and then compacted at a squeeze pressure of 10 to 12 kPa, with a maximum of 15 kPa being used in certain high demand applications.

Castings produced horizontally offer greater flexibility in terms of ease of manufacture and there are numerous application techniques available, with potential access to the entire pattern area allowing feeders to be placed as and where required. Castings produced vertically pose greater challenges to ensure that they are consistently sound, and feeding is typically restricted to the top or side feeders placed on the moulding joint line, which makes the feeding of isolated heavier sections very difficult.

There are essentially two types of feed requirements for any casting, including those produced in vertically parted moulds.

The first feeding requirement is modulus driven, whereby modulus is a proxy for the solidification time of the casting or section of casting to be fed. For this, the feeder metal has to be liquid for a sufficient time i.e. greater than that of the casting and or casting section, to enable the casting to solidify soundly without porosity and thus produce a sound defect free casting. For these applications, it is possible to use a standard rounded profile sleeve (with a feeder element such as those shown in WO2005/051568 and WO2007/141466). In particular, for high pressure vertically parted moulding lines, compressible feeder elements are required to give the necessary sand compaction between the base of the feeder element and the pattern surface, and it has been found that the compressible feeder elements such as those in WO2005/051568 and WO2007/141466 are suitable to give the necessary sand compaction together with consistently good feeder removal (small footprint and easy knock off).

The second feeding requirement is volume driven, i.e. there is a need to supply a certain volume of liquid metal to the casting. The volume is determined by several factors, primarily the casting weight and the liquid and solid metal shrinkage of the particular metal alloy. Another factor is ferrostatic pressure (effective height of the liquid metal feeder above the neck or contact with the casting), which is particularly important for castings produced in vertically parted moulds.

It is the volume requirement and the dimensional restrictions in vertically parted casting moulds that the present invention is primarily concerned with.

SUMMARY OF THE INVENTION

In order to supply a particular volume of liquid metal to a casting, it is desirable for the sleeve to include a cavity for a sufficient volume of liquid metal above the bore of the feeder neck leading to the casting, to provide a reservoir of metal and with sufficient ferrostatic pressure to feed into the casting. Due to space restrictions and yield requirements, it is not practical to simply use a larger standard shaped (i.e. circular cross-sectional or symmetrical) feeder. For the reasons mentioned above, it is also desirable to use compressible feeder elements for use in vertically parted high pressure mould machines to ensure good sand compaction between the feeder sleeve and the pattern and good feeder knock off.

First attempts to address this requirement involved the use of feeder sleeves having a body enclosing a large cavity extending into a lower frustoconical or cylindrical neck which was fitted with a circular compressible feeder element such as those described in WO2005/051568 and WO2007/141466. The sleeve body itself was circular, with a flat closed top, however, it was difficult to retain the position of the feeder sleeve on the swing (pattern) plate during the normal movements of the swing plate in the mould making cycle. This was alleviated by introducing internal ribs or fins on the internal feeder walls and or feeder neck so that it was in contact with the locating or support pin, employed to hold the feeder sleeve on the mould pattern prior to the sleeve being compressed into the mould. An alternative approach was to use a pin with a spring loaded mechanism such as a metal ball bearing or wire at the base of the pin, such that it is in contact with the feeder element and holds this in position during moulding. On moulding, the collapsible feeder element gave the required sand compaction and the feeder sleeve was maintained in the required position. However, on casting, there was insufficient feeding of the casting, resulting in shrinkage defects being formed in the casting. In an attempt to alleviate this by increasing the ferrostatic pressure, the base of the feeder sleeve was angled, such that when the pattern was in its moulding position (vertically parted), the top end of the sleeve was positioned above the horizontal plane of the feeder neck by an angle of up to 10 degrees. This improved the feed performance by increasing the ferrostatic pressure, but not enough to produce a defect free casting. It was not possible to increase this further by increasing the angle due to the difficulty in producing a suitable slot in the sleeve for the support pin, and removing the pin after moulding without damaging the sleeve.

An alternative approach attempted was to trial vertically elongate or oval shaped non-neck down sleeves with different feeder elements. To aid vertical alignment of the sleeve and prevent rotation of the feeder sleeve on the mould pattern prior to the sleeve being compressed into the mould, specially configured support pins were used. The pins were configured for insertion through the bore of the feeder element and the end of the pin was profiled e.g. a flat blade or fin, such that it only mated with the sleeve/feeder element in one orientation and thus prevented rotation of the sleeve on the pin. Although this overcame the problem of orientation, it was found that on compression of the sand mould the feeder sleeve tended to crack. If a non-compressible neck down feeder element comprised of a resin bonded sand breaker core was used there was insufficient compaction of the moulding sand between the base of the feeder element under the sleeve and adjacent to the pattern plate, and the high moulding pressures led to cracking and breakages of the feeder element. Similarly, if a circular compressible feeder element such as those described in WO2005/051568 and WO2007/141466 was used in conjunction with a second elongate resin-bonded neck down feeder element and a feeder sleeve (i.e. a three component system) fractures and breakages to the neck down component were observed.

It is therefore an object of the present invention to provide a feeder element and feeder system that can be used in a cast moulding operation employing a pressure moulded vertically parted automatic or semi-automatic moulding machine.

According to a first aspect of the present invention, there is provided an elongate feeder element for use in metal casting, said feeder element having a length, a width and a height, said feeder element comprising:

an A end and an opposite B end measured along the height, and a C end and an opposite D end measured along the length, said A end for mounting on a mould pattern or swing plate and said opposite B end for receiving a feeder sleeve; and a bore between the A and B ends defined by a sidewall comprising a stepped collapsible portion;

said feeder element being compressible in use whereby to reduce the distance between the A and B ends;

wherein said sidewall has a first sidewall region defining the B end of the feeder element which serves as a mounting surface for a feeder sleeve in use, and a second sidewall region contiguous with the first sidewall region, wherein said stepped collapsible portion comprises a series of third sidewall regions in the form of concentric rings of decreasing diameter integrally formed with a series of fourth sidewall regions in the form of concentric annuli of decreasing diameter;

characterised in that said bore has an axis that is offset from the centre of the feeder element along the length toward the C end and said second sidewall region is non-planar, contiguous with a third sidewall region and located between the bore axis and the D end.

Embodiments of the invention can therefore provide an asymmetrical feeder element that is suitable for use in high pressure vertically parted mould machines (such as those manufactured by DISA Industries A/S). As described above, it can be advantageous to use asymmetric feeder sleeves such that in use there is an increased height above the bore axis. This provides for a greater volume of metal and ferrostatic (head) pressure above the bore axis and feeder neck to ensure a greater and more efficient flow of molten metal into a mould cavity.

The Applicants therefore decided to trial open-sided sleeves (instead of providing a lower neck down portion) such that the feeder element was provided on a plate arranged to abut the edge of the sleeve's open-side. Thus, feeder elements such as those described in WO2005/051568 and WO2007/141466 were simply provided on elongate plates for use on elongate sleeves (see FIG. 1). However, it was discovered that when high mould pressure was applied to these components, the compressible part of the feeder element collapsed as required, however, the forces absorbed and transmitted through the collapsible part and into the elongate plate caused the portion of the feeder element in contact with the sleeve to unexpectedly buckle and bend outwardly from the sleeve (see FIG. 1). This was not satisfactory because it could allow molten metal to escape from parts of the feeder sleeve other than the bore, which could, in turn, affect the casting quality and efficiency. It was therefore desirable to design a feeder element which included a collapsible portion to collapse under high pressure as well as an elongate portion which would remain rigid and not distort even when high mould pressure was applied asymmetrically.

As it was observed that the portion of the sidewall closest to the centre of the elongate plate tended to collapse inwardly more than the remainder of the sidewall, initial work concentrated on reinforcing that area (see FIG. 2). However, it was unexpectedly found that the inclusion of an additional arc-shaped metal strengthening rib in the central region of the plate or the welding of an additional metal piece to thicken the plate in this region, did not fully prevent the plate from buckling. Whilst it may be possible to prevent the deformation by making the whole of the feeder element from thicker metal, this would also prevent the bore from collapsing under pressure and so would not provide a practical solution. An alternative solution considered therefore involved the preparation of a two part unit where the compressible portion is attached to a thicker, more rigid plate. However, this solution was considered to be impractical and prohibitively expensive as machines which are designed to give high volume, long runs, and a lowest cost casting production require consumable parts like feeder elements to be low cost in order to be commercially viable.

After further work toward a practical solution, it was surprisingly found that the inclusion of a non-planar portion adjacent the compressible portion appeared to strengthen the plate to prevent buckling during compression.

As each of the prior art feeder elements were designed for feeder sleeves having a symmetrical neck (which is circular in cross-section) none of them has addressed the problem that the present invention aims to solve. Instead, the prior art has focussed on the feeder systems where the sleeves have circular walls around central bores, such as those described in WO2007/141466 and DE 201 12 425 U1. In DE 201 12 425 U1 the feeder element is rigid and does not deform in use, and in certain embodiments the mounting surface has a pair of spaced circular walls (lips) such that on moulding, the inner lip ensures that any broken pieces of the sleeve wall are retained in position and do not fall into the mould (and casting).

The feeder element is elongate i.e. the length is longer than the width. If used in a vertically parted mould the length will be vertical and the width and height will be horizontal. In specific embodiments, the feeder element may be substantially oval, elliptical, rectangular, non-regular polygonal or obround (i.e. having two parallel straight sides and two part-circular ends). In a particular embodiment, the feeder element is obround.

It will be understood that the length, width and height are mutually orthogonal.

The first sidewall region defining the B end of the feeder element is the sidewall region that is displaced the greatest distance from the A end, measured along the height (parallel to bore axis). The first sidewall region serves as a mounting surface in use and therefore makes contact with the open side of a feeder sleeve.

It will be understood that the feeder element of the present invention comprises the first sidewall region (comprising the mounting surface), the second sidewall region (contiguous with the first sidewall region and a third sidewall region) and a compressible portion (comprising third and fourth sidewall regions). The second sidewall region thereby forms a bridge between the mounting surface and the collapsible portion.

The second sidewall region is non-planar and has a height measured in the direction of the bore axis. The height of the second sidewall region can be compared to the height of the feeder element (the distance between the A and B ends). In one series of embodiments the height of the second sidewall region (before compression) is from 5 to 35%, from 8 to 30%, from 10 to 25% or from 14 to 21% of the height of the feeder element.

Without being bound by theory, the inventors postulate that the non-planar shape helps to "funnel" the sand and thereby improves sand compaction between the feeder element and the mould.

In one embodiment the second sidewall region is symmetrical about a mirror plane that passes through the bore axis from the C end to the D end. In a particular embodiment, the entire feeder element is symmetrical about the mirror plane. It is believed that a symmetrical feeder element more evenly distributes the stresses involved in ramming up.

In one embodiment the second sidewall region curves away from the B end, towards the A end and back toward the B end across the width of the feeder element and thereby forms an arch. The arch is visible in cross-section when viewing the feeder element along its length. The arch is concave relative to the B end and convex relative to the A end. The height of the arch is the height of the second sidewall region.

In one embodiment the second sidewall region flares outward from the collapsible portion to the first sidewall region. The bore axis lies in an infinite number of planes that pass though the feeder element. In one embodiment the second sidewall region is shaped such that its cross-section is linear in the plane which passes through the bore axis from the C end to the D end. In a further embodiment, the second sidewall region is shaped such that its cross-section is linear in each of the planes which contain the bore axis.

In one embodiment the second sidewall region makes an angle relative to the bore axis of $\beta$ at the D end (upper end in use) and an angle $\gamma$ at the C end (lower end in use). In a series of embodiments $\beta$ is at least 60, 70 or 80°. In another series of embodiments $\gamma$ is at least 5, 10, 15, 20 or 25°. In a particular embodiment $\beta$ is greater than $\gamma$.

For practical reasons, the bore axis is preferably located substantially centrally with respect to the width of the feeder element and/or the second sidewall region.

The bore axis is offset from the centre of the feeder element along the length by a distance X (X>0). The distance X can be compared to the length of the feeder element L. In one series of embodiments X/L is at least 5, 10 or 15%. In another series of embodiments X/L is less than 25, 20 or 15%. In a particular embodiment X/L is from 16 to 18%. This means that the bore axis if offset from the centre of the feeder element by approximately ⅙ of the length.

The second sidewall region is located between the bore axis and the D end of the feeder element. In some embodiments, the second sidewall region extends around the bore axis such that it is also located between the bore axis and the C end. In other embodiments, the second side wall is not located between the bore axis and the C end.

The first sidewall region (the mounting surface) is in contact with a feeder sleeve in use. In order to prevent leakage of metal from between the feeder element and the feeder sleeve, there must be a snug fit. The first sidewall region must therefore extend continuously around the periphery of the feeder element. Typically the open side of the feeder sleeve will be profiled to have a snug fit with the first sidewall region. The first sidewall region can be considered to be a mounting ring, band or strip.

It is believed that the force applied to the feeder element is greater in the vicinity of the bore than in the remainder of the feeder element and, as a result, a bending moment is generated. The inclusion of a non-planar portion increases the rigidity of the second sidewall region and provides resistance to the bending moment.

The depth of the first sidewall region (the distance from the inner diameter to the outer diameter of the first sidewall region) is not particularly limited and will depend on the size of the feeder sleeve. In certain embodiments the depth of the first sidewall region (or the average depth of the first sidewall region if this is not consistent) may be at least 5, 10 or 15 mm. In alternative embodiments the depth of the first sidewall region (or average depth of the first sidewall region) may be less than 50, 45, 40, 35, 30, 25, 20, 15 or 10 mm. In a particular embodiment the first sidewall region has a depth (or average depth) of from 5 to 15 mm.

In one embodiment the first sidewall region (mounting surface) is inclined relative to the bore axis by more than 0° and up to (and including) 90°. In another embodiment the first sidewall region (mounting surface) is inclined relative to the bore axis by an angle $\alpha$ where $0<\alpha<90$. In one series of embodiments $\alpha$ is at least 30, 40, 45, 50, 55, 60, 65, 70 or 75°. In one series of embodiments $\alpha$ is less than 85, 75, 70, 65, 60, 55 or 45°. In a particular embodiment $\alpha$ is from 50 to 70°.

The sidewall defining the bore may comprise steps and thereby provide a compressible portion (i.e. a stepped collapsible portion). In such an embodiment, the sidewall may comprise at least one step. In a series of embodiments at least 2, 3, 4, 5, 6 or 7 steps may be provided. In an alternative series of embodiments fewer than 15, 12, 10, 9, 8, 7, 6, 5, 4 or 3 steps may be provided. In a particular embodiment the stepped sidewall comprises from 3 to 6 steps.

In one embodiment, the second sidewall region and the collapsible portion have substantially the same width.

In one series of embodiments, the length (or maximum diameter if the collapsible portion comprises circular steps) of the collapsible portion is from 35 to 70%, from 40 to 60% or from 45 to 50% of the length of the feeder element.

Each step may be substantially circular, oval, elliptical, square, rectangular, polygonal or obround. Each step may be of the same (or a different) shape as the other steps. In a particular embodiment the sidewall comprises at least 3 circular steps.

Each step may be formed by a third sidewall region and a fourth sidewall region contiguous with the third sidewall region but wherein the fourth sidewall region is provided at a different angle, with respect to the bore axis, to the third sidewall region. It will be understood that the third sidewall region may be integrally formed with all or part of the second sidewall region.

The third sidewall region may be parallel to the bore axis or may be inclined to the bore axis by less than 90°. The fourth sidewall region may be perpendicular to the bore axis or inclined away from the A end and toward the bore axis by less than 90°.

The sidewall of the feeder element comprises a series of third sidewall regions (said series having at least one member) in the form of concentric rings of decreasing diameter (when said series has more than one member) interconnected and integrally formed with a series of fourth sidewall regions (said series having at least one member) in the form of concentric annuli of decreasing diameter. The series of third and fourth sidewall regions together form a stepped portion of the sidewall and can be considered to be the compressible portion of the feeder element. The sidewall regions may be of substantially uniform thickness, so that the diameter of the bore of the feeder element increases from the A end to the B end of the feeder element. Conveniently, the series of third sidewall regions is cylindrical (i.e. parallel to the bore axis), although they may be frustoconical (i.e. inclined to the bore axis). Conveniently, the series of fourth sidewall regions is perpendicular to the bore axis. Both series of sidewall regions may be of circular shape or of non-circular shape (e.g. oval, elliptical, square, rectangular, polygonal or obround).

The feeder element may have as many as six or more of each of the interconnected and integrally formed third and fourth sidewall regions. In one particular embodiment, five of the third sidewall regions are interconnected and integrally formed with four of the fourth sidewall regions. In another embodiment three of the third sidewall regions are interconnected and integrally formed with two of the fourth sidewall regions.

In some embodiments, the distance between the inner and outer diameters of the fourth sidewall regions is from 3 to 12 mm or from 5 to 8 mm. The thickness of the sidewall regions may be 0.2 to 1.5 mm, 0.3 to 1.2 mm or 0.4 to 0.9 mm. The ideal thickness of the sidewall regions will vary from element to element and be influenced by the size, shape and material of the feeder element, and by the process used for its manufacture. In embodiments where the feeder element is press-formed from a single metal sheet, the thickness of the second sidewall region will be substantially the same as the thickness of the third and fourth sidewall regions.

It will be understood from the foregoing discussion that the feeder element is intended to be used in conjunction with a feeder sleeve. Thus, the invention provides in a second aspect a feeder system for metal casting comprising a feeder element in accordance with the first aspect and a feeder sleeve secured thereto, the feeder sleeve being profiled to match the angle of the first sidewall region.

A standard feeder sleeve configured for use with a horizontally parted mould machines typically comprises a hollow body having a curved exterior and an open annular base for mounting onto a circular breaker core (collapsible or otherwise) from above. For certain applications the feeder sleeve may also be non-circular with an annular base for mounting on a non-circular breaker core.

In the feeder system of the second aspect, the feeder sleeve may be configured for use with vertically parted mould machines and may comprise a hollow body having an open side configured to mate with the mounting surface of the feeder element. The open side may be circular or non-circular in shape but is preferably elongate (i.e. the sleeve has a length and a width wherein the length is greater than the width). In specific embodiments, the open side may be substantially oval, elliptical, square, rectangular, polygonal or obround (i.e. having two parallel straight sides and two part-circular ends).

It will be understood that the amount of compression and the force required to induce compression will be influenced by a number of factors including the material of manufacture of the feeder element and the shape and thickness of the sidewall. It will be equally understood that individual feeder elements will be designed according to the intended application, the anticipated pressures involved and the feeder size requirements.

The feeder element is compressible in use (during moulding). The initial crush strength is the force required to initiate compression and irreversibly deform the feeder element over and above the natural flexibility that it has in its unused and uncrushed state. WO2007/141466 includes a number of graphs showing the deformation of feeder elements when subjected to a force. A sample graph from WO2007/141466 is enclosed for reference to demonstrate the initial crush strength. Referring to FIG. 3*a*, force is plotted against plate displacement for a feeder sleeve without a feeder element (upper line) and the same feeder sleeve with a feeder element (lower line). Referring to the upper line. It will be noted that as force is increased, there is compression of the feeder sleeve associated with the natural flexibility (compressibility) of the feeder sleeve until a critical force is applied (point O), referred to herein as the sleeve crush strength (approximately 4.5 kN) after which point the compression of the sleeve proceeds steadily under a reducing loading. Referring to the lower line, it will be noted that as force is increased, there is minimal compression of the feeder element and sleeve, until a critical force is applied (point P), referred to as the initial crush strength, after which compression proceeds rapidly under a lower loading. FIG. 3*b* shows the results from a compression test conducted on a feeder element 20 in accordance with an embodiment of the invention (shown in FIG. 4) with a feeder sleeve 60 (shown in FIGS. 6). As for the previous test, it can be seen that as force is increased, there is minimal compression of the feeder element and sleeve until the initial crush strength (point P, approximately 2 kN). Compression then proceeds under a lower loading, with point Q marking the minimum force measurement after the initial crush strength occurs. Further compression occurs and the force increases to further maximum points (R and T) and minimum points (S and U) which are associated with the onset and ending of the stepped stages of collapsing of the feeder element under the steady application of force during the compression test.

If the initial crush strength is too high, then moulding pressure may cause the feeder sleeve to fail before compression of the feeder element is initiated. Hence, for practical reasons, the feeder system will typically comprise a feeder element and a feeder sleeve where the initial crush strength of the feeder element is lower than the crush strength of the feeder sleeve. In one series of embodiments the initial crush strength of the feeder element is no more than 7 kN (7000N), 6 kN, 5 kN, 4 kN or 3 kN. In another series of embodiments the initial crush strength may be at least 250N, 500N, 750N or 1000N (1 kN). If the crush strength is too low, then compression of the feeder element may be initiated accidentally, for example if a plurality of elements is stacked for storage or during transport.

The feeder element of the present invention may be regarded as a collapsible breaker core as this term suitably describes some of the functions of the element in use. Traditionally, breaker cores comprise resin bonded sand. They may also comprise a ceramic material or a core of feeder sleeve material. However, the feeder element of the current invention can be manufactured from a variety of other suitable materials including metal (e.g. steel, aluminium, aluminium alloys, brass, copper etc.) or plastic. In one embodiment the feeder element is metal and in a particular embodiment, the feeder element is steel. In certain configurations it may be more appropriate to consider the feeder element to be a feeder neck.

In certain embodiments, the feeder element may be formed from metal and may be press-formed from a single metal plate of constant thickness. In an embodiment the feeder element is manufactured via a drawing process, whereby a metal sheet blank is radially drawn into a forming die by the mechanical action of a punch. The process is considered deep drawing when the depth of the drawn part exceeds its diameter and is achieved by redrawing the part through a series of dies. To be suitable for press-forming, the metal should be sufficiently malleable to prevent tearing or cracking during the forming process. In certain embodiments the feeder element is manufactured from cold-rolled steels, with typical carbon contents ranging from a minimum of 0.02% (Grade DC06, European Standard EN10130-1999) to a maximum of 0.12% (Grade DC01, European Standard EN10130-1999). Other carbon contents (e.g. greater than 0.12%, 0.15% or 0.18%) may be suitable if the feeder element is made by different means.

As used herein, the term "compressible" is used in its broadest sense and is intended only to convey that the height of the feeder element between the A and B ends is shorter after compression than before compression. In one embodiment, said compression is non-reversible i.e. after removal of the compression inducing force the feeder element does not revert to its original shape.

In one embodiment, the free edge of the sidewall region defining the A end of the feeder element has an inwardly directing lip or annular flange.

The compression behaviour of the feeder element can be altered by adjusting the dimensions of each sidewall region. In one embodiment, all of the series of third sidewall regions have the same length and all of the series of fourth sidewall regions have the same length (which may be the same as or different from one another and which may be the same as or different from the first sidewall region). In a particular embodiment however, the length of the series of third sidewall regions and/or the series of fourth sidewall regions incrementally increases towards the A end of the feeder element.

The surface area of the feeder sleeve in contact with the feeder element can be described as the contact area. In one series of embodiments at least 75, 80, 85, 90 or 95% of the contact area of the sleeve is with the first sidewall region (mounting surface). In a particular embodiment, 100% of the contact area of the sleeve is with the first sidewall region i.e. the feeder sleeve is in contact with the first sidewall region but is not in contact with the second sidewall region.

The walls of the feeder sleeve may be thickened in certain regions to increase the surface area of the open side and provide greater contact area and thus greater support on the mounting surface of the feeder element. The wall of the feeder sleeve that forms the base of the feeder in use may also be profiled e.g. sloped downwards towards the position of the casting to further promote the flow and feed of molten metal from the feeder into the casting.

In use, the sleeve will be orientated such that its open side lies along a substantially vertical plane and the feeder element is located on the open side such that the bore is provided closer to a lower end of the sleeve than an upper end of the sleeve. Accordingly, the design of the feeder system will allow a head of molten metal to be provided in the sleeve above the bore to ensure an efficient supply of molten metal to the mould.

The nature of the feeder sleeve is not particularly limited and it may be for example insulating, exothermic or a combination of both. Neither is its mode of manufacture particularly limited, it may be manufactured for example using either the vacuum-forming process or core-shot method. Typically a feeder sleeve is made from a mixture of low and high density refractory fillers (e.g. silica sand, olivine, alumino-silicate hollow microspheres and fibres, chamotte, alumina, pumice, perlite, vermiculite) and binders. An exothermic sleeve further requires a fuel (usually aluminium or aluminium alloy), an oxidant (typically iron oxide, manganese dioxide, or potassium nitrate) and usually initiators/sensitisers (typically cryolite).

In one series of embodiments the feeder sleeve has a strength (crush strength) of at least 3.5 kN, 5 kN, 8 kN, 12 kN, 15 kN or 25 kN. In one series of embodiments, the sleeve strength is less than 25 kN, 20 kN, 18 kN, 15 kN, 10 kN or 8 kN. For ease of comparison the strength of a feeder sleeve is defined as the compressive strength of a 50×50 mm cylindrical test body made from the feeder sleeve material. A 201/70 EM compressive testing machine (Form & Test Seidner, Germany) is used and operated in accordance with the manufacturer's instructions. The test body is placed centrally on the lower of the steel plates and loaded to destruction as the lower plate is moved towards the upper plate at a rate of 20 mm/minute. The effective strength of the feeder sleeve will not only be dependent upon the exact composition, binder used and manufacturing method, but also on the size and design of the sleeve, which is illustrated by the fact that the strength of a test body is usually higher than that measured for a standard flat topped 6/9K sleeve.

Feeder sleeves are available in a number of shapes including cylinders, ovals and domes. The sleeve body may be flat topped, domed, flat topped dome, or any other suitable shape. The feeder sleeve may be conveniently secured to the feeder element by adhesive but may also be push fit or have the sleeve moulded around part of the feeder element. Preferably the feeder sleeve is adhered to the feeder element.

It is preferable to include a Williams Wedge inside the feeder sleeve. This can be either an insert or preferably an integral part produced during the forming of the sleeve, and comprises a prism shape situated on the internal roof of the sleeve. On casting when the sleeve is filled with molten metal, the edge of the Williams Wedge ensures atmospheric puncture of the surface of the molten metal and release of the vacuum effect inside the feeder to allow more consistent feeding. Typically the Williams Wedge will make little or no contact with the feeder element.

The feeder system may further comprise a support pin to hold the feeder sleeve on the mould pattern prior to the sleeve being compressed into the mould. The support pin will be configured for insertion through the offset bore of the feeder element and may be configured to prevent the sleeve and/or feeder element from rotating relative to the pin during compression (e.g. an end of the pin may be profiled such that it only mates with the sleeve/feeder element in one orientation). The support pin may also be further configured to include a device adjacent to the base of the pin, and which is in contact with and holds the feeder element in position during the moulding cycle. This device may comprise, for example, a spring-loaded ball bearing or a spring clip that forms a pressure/contact with the internal surface of the first sidewall region of the feeder element. Other methods of holding the feeder system in place on the pattern plate during the moulding cycle may be employed, provided that certain services can be supplied to the swing plate of the moulding machine e.g. the base of a moulding pin may be temporarily magnetised using an electric coil such that when a steel or iron feeder element is used, the feeder system is held in place during moulding, or the feeder system can be placed over an inflatable bladder on the pattern plate which when inflated via compressed air, will expand against the internal bore walls of the feeder element and or sleeve during moulding. In both of these examples, the electromagnetic force or compressed air will be released immediately after moulding to allow release of the mould and sleeve system from the pattern plate. Permanent magnets may also be used in the base of the moulding pin and/or in the area of the pattern plate adjacent to the base of the moulding pin, the force of the magnet(s) being sufficient to hold the feeder system in place during the moulding cycle but low enough to allow its release and maintaining the integrity of the combined mould and sleeve system when removed from the pattern plate at the end of the moulding cycle.

BRIEF DESCRIPTION OF THE DRAWINGS

Embodiments of the invention will now be described by way of example only with reference to the accompanying drawings in which:—

DETAILED DESCRIPTION OF SPECIFIC EMBODIMENTS

Figure 1B:
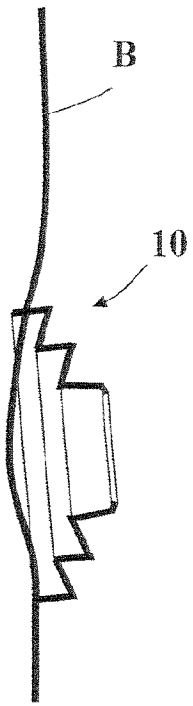
FIG. 1B shows the feeder element of FIG. 1A after compression.
Figure 1A:
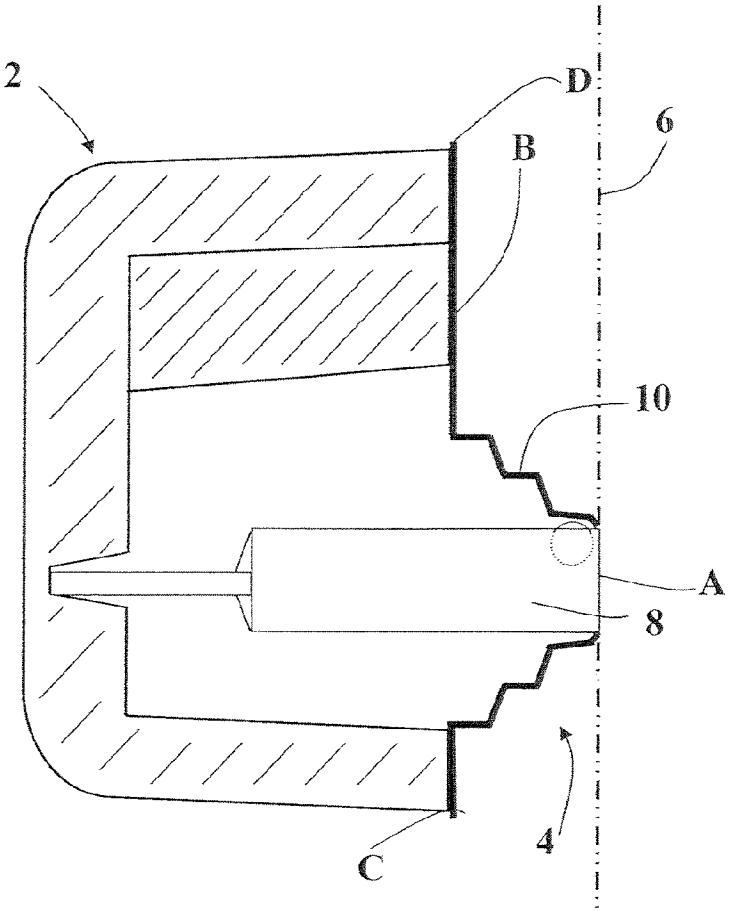
FIG. 1A shows a comparative feeder element and feeder sleeve.

FIG. 1A shows a comparative feeder sleeve 2 mounted on a comparative feeder element 4, mounted on a mould pattern 6 via a fixed pin 8. This is an unsuccessful attempt to design a feeder system for use in a vertically parted mould.

The feeder element 4 has an A end for mounting on the mould pattern 6 and an opposite B end for receiving the feeder sleeve 2 and a bore between the A and B ends defined by a stepped sidewall 10. The bore axis is offset from the centre of the feeder element toward the C (lower) end. The spring pin 8 is modified for use in a vertically parted mould. It has a non-circular cross-section so that the feeder element and feeder sleeve are held securely and do not rotate. On moulding, the stepped sidewall 10 collapses allowing the feeder element to compress and reducing the distance between the A and B ends.

However, as shown in FIG. 1B, it has surprisingly been found that when the bore is offset from the centre of the feeder element, the mounting surface (defining the B end) buckles allowing molten metal to escape from parts of the feeder sleeve.

Hence, a feeder element for use in vertically parted sleeves cannot be obtained solely by offsetting the bore.

Figure 2B:
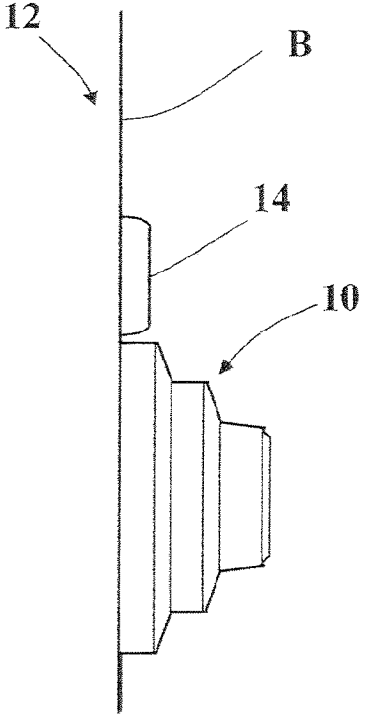
FIGS. 2A and 2B show a comparative feeder element.
Figure 2A:
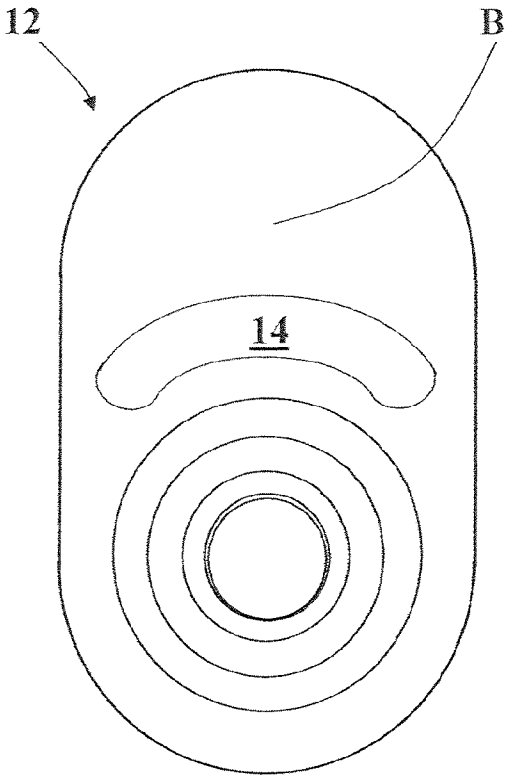

FIG. 2 shows a comparative feeder element 12. This a further unsuccessful attempt to design a feeder system for use in a vertically parted mould and is not prior art. The feeder element 4 of FIG. 1 was modified by form pressing an arch-shaped rib 14 to thicken the mounting plate. When used together with a feeder sleeve, the additional feature slightly reduced but did not eliminate buckling when subjected to pressure on moulding.

FIG. 4 is a feeder element 20 in accordance with an embodiment of the invention. The feeder element 20 comprises an A end for mounting on a mould pattern (not shown); an opposite B end for mounting on a feeder sleeve (not shown); and a bore between the A and B ends defined by a stepped sidewall 22. The bore has an axis Z through its centre which is offset from the centre of the feeder element by a distance X. The feeder element has a height H measured along the bore axis from the A end to the B end.

The first sidewall region 24 defines the B end of the feeder element and serves as a mounting surface for a feeder sleeve in use. The first sidewall region (mounting surface) 24 is inclined away from the A end relative to the bore axis by an angle α (α=) 60°. The feeder element has an obround shape having two longitudinal straight edges 26 joined by an upper-part circular top edge 28 and a lower part-circular bottom edge 30. The feeder element 20 therefore has a length L defined by the distance between the lowermost portion of the bottom edge 30 (the C end) and the uppermost portion of the top edge 28 (the D end) and a width W defined by the distance between the two longitudinal edges 26.

As illustrated, the bore axis Z is offset towards the C end and is provided centrally across the width of the feeder element. The bore axis Z is located at approximately ⅓ of the length of the feeder element so the distance X is approximately ⅙ (17%) of the length of the feeder element.

Figure 3A:
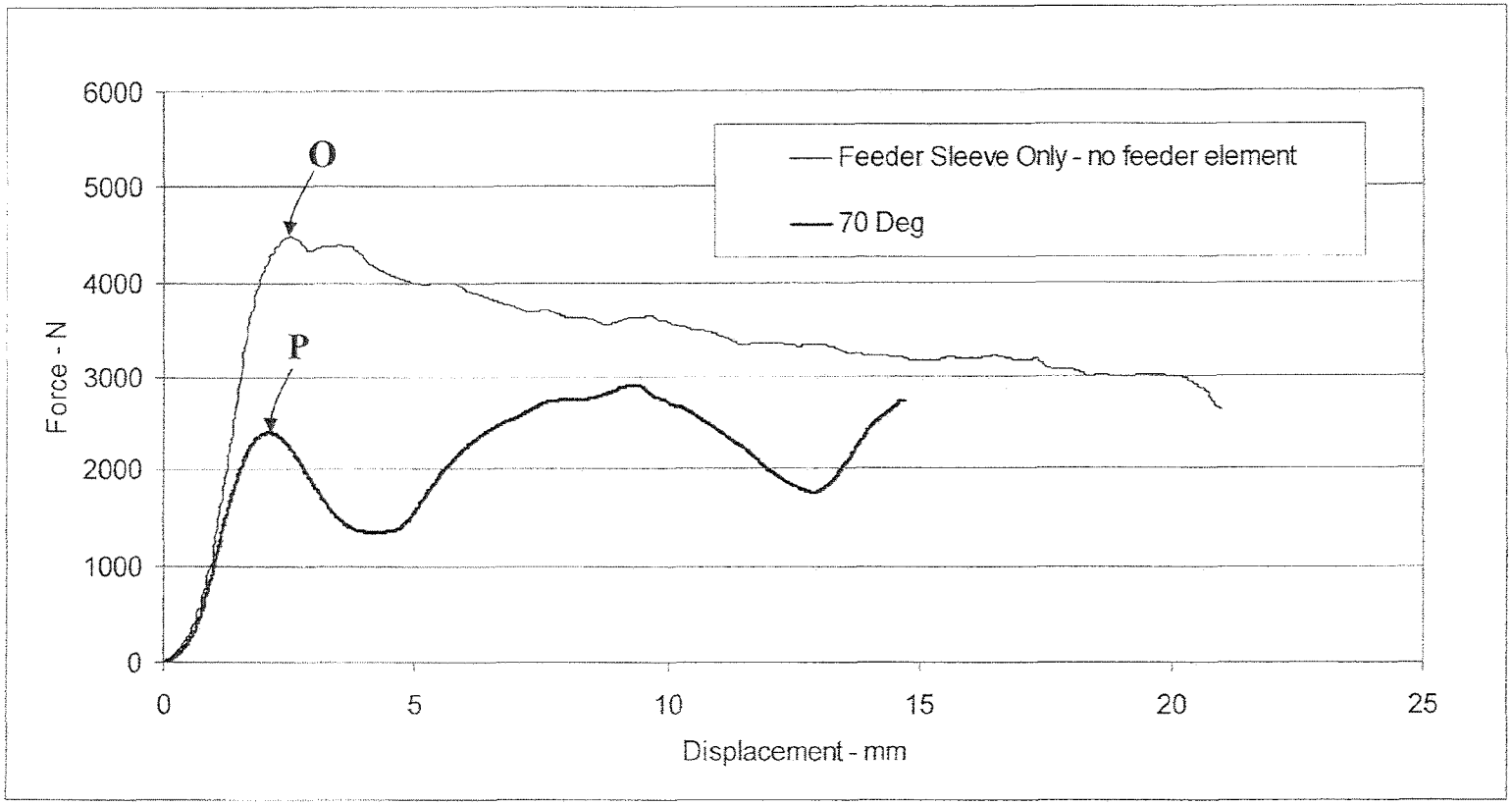
FIG. 3A is a plot of force against displacement for a prior art feeder sleeve and feeder system.
Figure 3B:
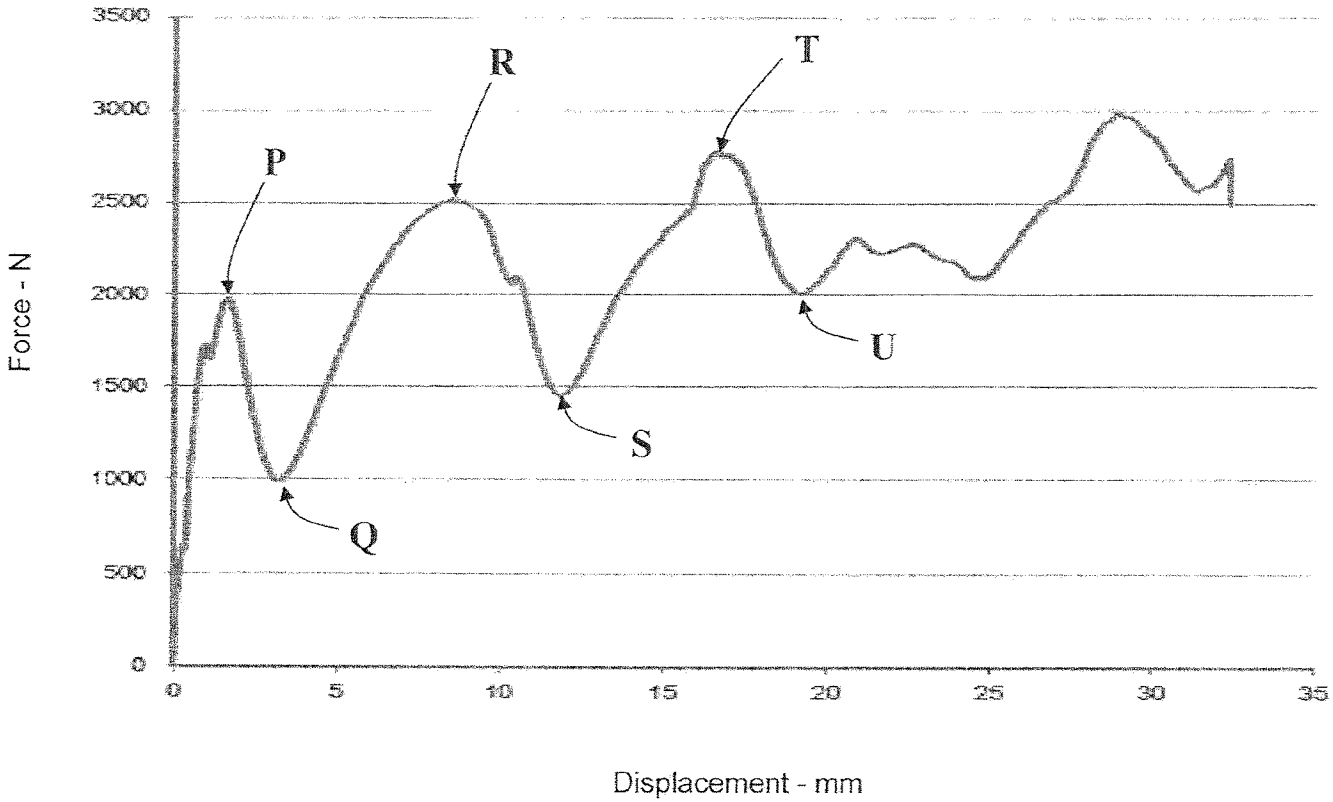
FIG. 3B is a plot of force against displacement for a feeder system comprising a feeder element in accordance with an embodiment of the invention (as shown in FIG. 4) and a feeder sleeve (shown in FIG. 6) designed specifically for use with the feeder element.
Figure 4A:
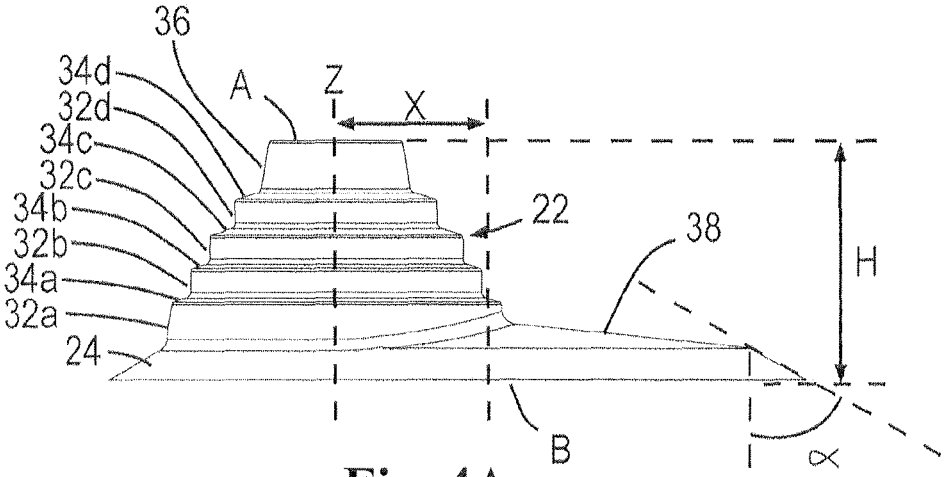
FIGS. 4A-4D show, respectively, side, plan, end and perspective views of a feeder element in accordance with an embodiment of the invention.
Figure 4B:
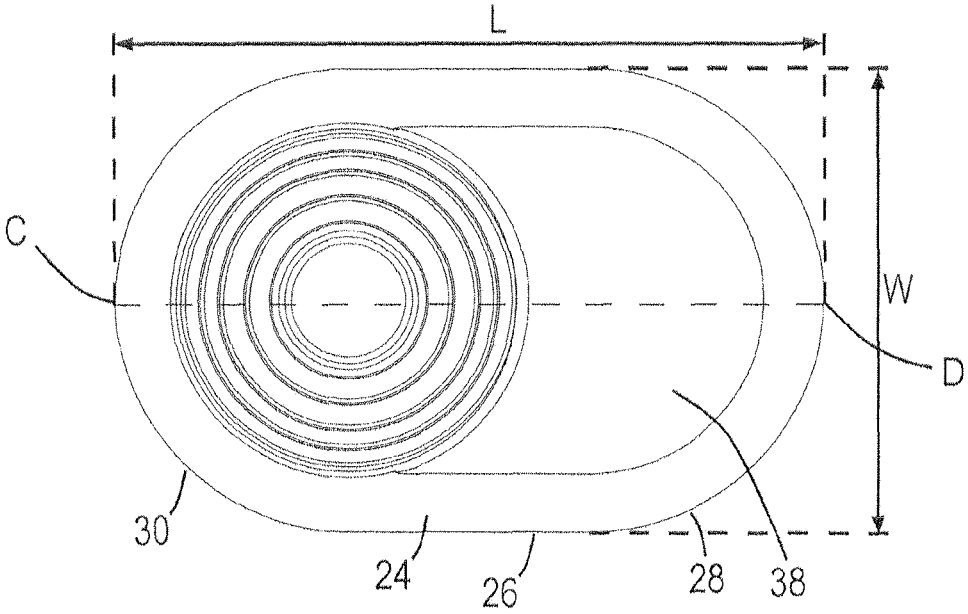
Figure 4D:
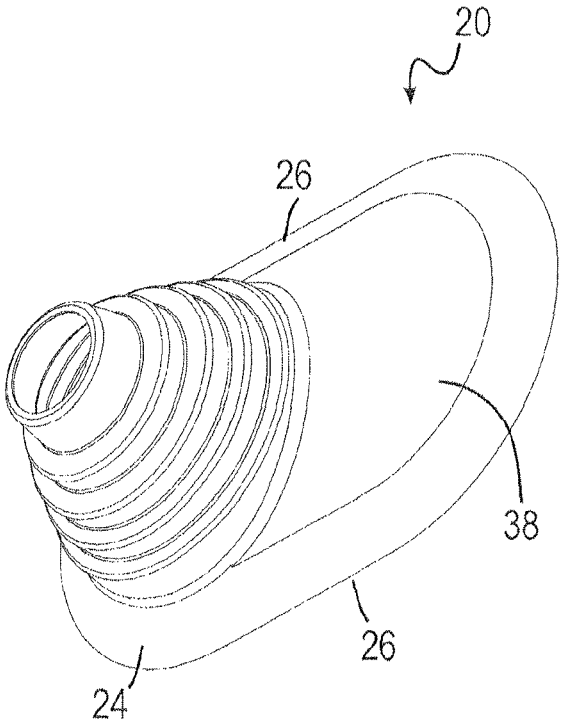
Figure 4C:
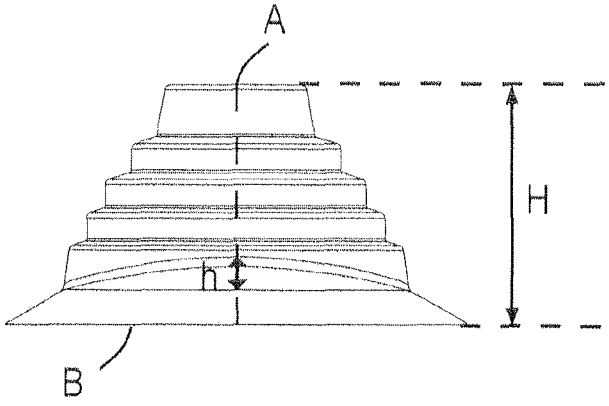
Figure 5A:
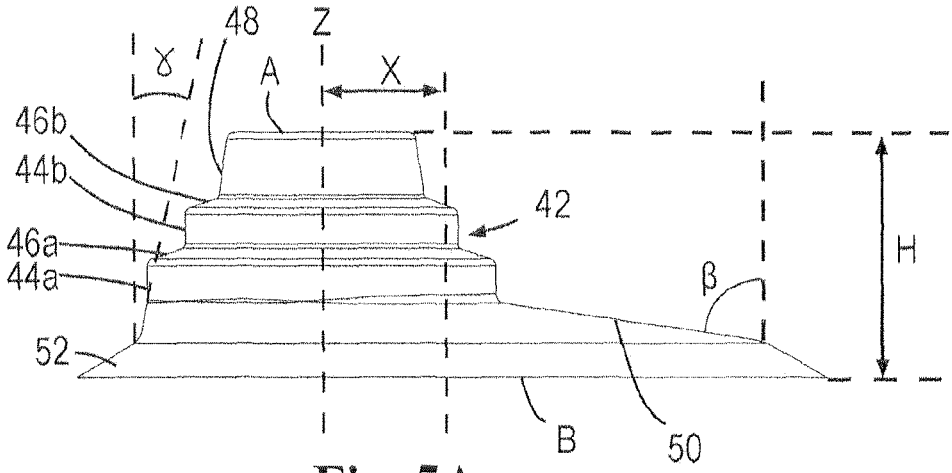
FIGS. 5A-5D show, respectively, side, plan, end and perspective views of a feeder element in accordance with another embodiment of the invention.
Figure 5B:
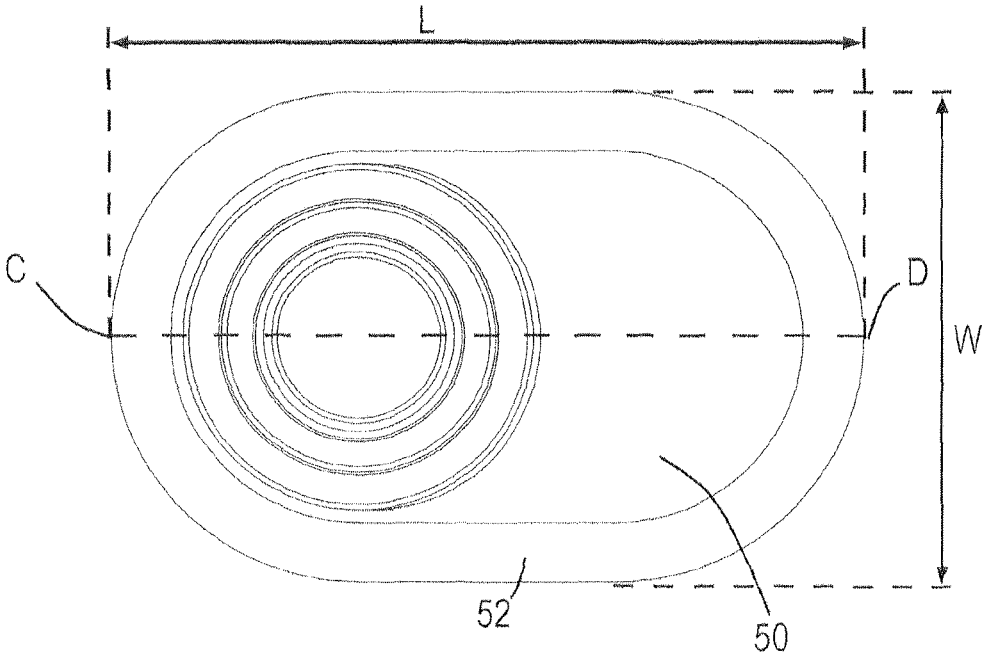
Figure 5D:
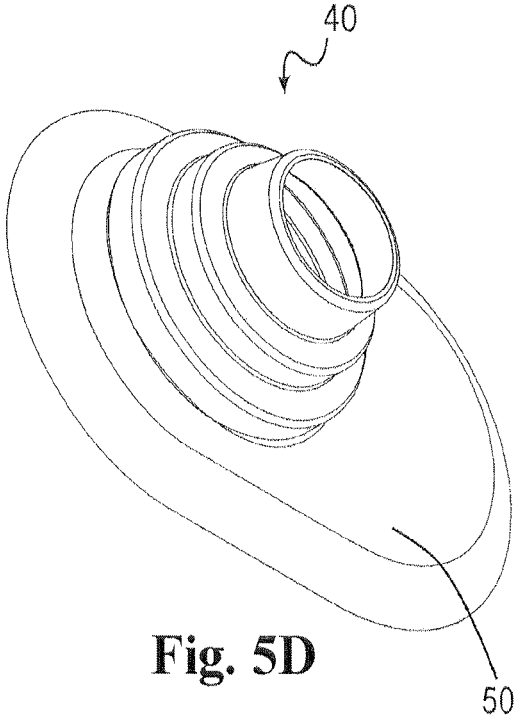
Figure 5C:
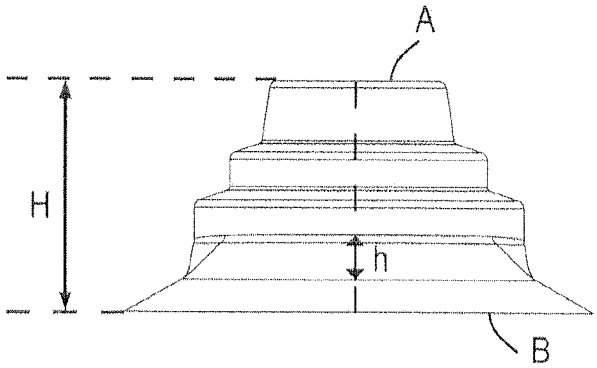

The feeder element 20 is of unitary construction and is press-formed from a single metal sheet and is designed to be compressible in use whereby to reduce the distance between the A and the B ends. This feature is achieved by the construction of the stepped sidewall 22, which in the present case comprises four circular steps between the A and the B ends. The first (and largest) step comprises a third sidewall region 32*a*, which is almost parallel to the bore axis Z; and a fourth sidewall region 34*a*, which is inclined to the bore axis Z and thereby forms a frustoconical ledge. The subsequent steps are similar to the first step and comprise third sidewall regions (rings) 32*b,c,d* which are parallel to the bore axis Z and fourth sidewall regions (annuli) 34*b,c,d* which are inclined to the bore axis Z and thereby form frustoconical ledges. A frustoconical portion 36 extends from the inner circumference of the fourth sidewall region 34*d* to the A end to provide the opening to the bore and an inwardly directed lip is formed at the A end to provide a surface for mounting on the mould pattern and produce a notch in the resulting cast feeder neck to facilitate its removal (knock off). In other embodiments, more steps may be provided and the third and/or fourth sidewall regions may be variously inclined or parallel or perpendicular to the bore axis Z. The initial crush strength of the feeder element 20 is approximately 2 kN as shown in FIG. 3*b*.

The circular steps provide the compressible portion in the feeder element 20. A second sidewall region 38 provides a bridge from the compressible portion to the first sidewall region (mounting surface) 24. The second sidewall 38 region is contiguous with the first sidewall region 24 and also the third sidewall region 32*a*. In this embodiment the second sidewall region 38 does not extend around the bore toward the C end. Hence the third sidewall region 32*a* is contiguous with the first sidewall region.

The second sidewall region 38 and the collapsible portion (i.e. the diameter of the third sidewall region 32*a*) have substantially the same width. The length of the collapsible portion (i.e. the diameter of the third sidewall region 32*a*) is approximately 50% of the length of the feeder element 20.

It is clear that the second sidewall region 38 is non-planar. Looking along the length, it can be seen that the second sidewall region 38 curves away from the B end, toward the A end and back toward the B end and thereby forms an arch. The maximum height of the arch (h) is approximately 15% of the height of the feeder element (H).

The second sidewall region 38 (and also the entire feeder element 20) is symmetrical about a mirror plane that passes through the bore axis Z from the C end to the D end. This mirror plane is shown by a dashed line in FIGS. 4*b* and 4*c*.

FIG. 5 shows a feeder element 40 in accordance with an embodiment of the invention. The feeder element 40 is similar to the feeder element 20 but the second sidewall region (bridging portion) is flared and the compressible portion has fewer steps.

The feeder element 40 comprises an A end for mounting on a mould pattern (not shown); an opposite B end for mounting on a feeder sleeve (not shown); and a bore between the A and B ends defined by a stepped sidewall 42. The bore has an axis Z through its centre which is offset from the centre of the feeder element by a distance X. The feeder element has a height H measured along the bore axis from the A end to the B end.

The feeder element 40 is press-formed from a single metal sheet and is designed to be compressible in use whereby to reduce the distance between the A end and the B end. This feature is achieved by the construction of the stepped sidewall 42 comprising two circular steps between the A and the B ends. The first (and largest) step comprises a third sidewall region (ring) 44*a*, which is parallel to the bore axis Z; and a fourth sidewall region (annulus) 46*a*, which is inclined to the bore axis Z and thereby forms a frustoconical ledge. The subsequent step is similar to the first step 44*a* and comprises a third sidewall region 44*b*, which is parallel to the bore axis Z; and a fourth sidewall region 46*b* which is inclined to the bore axis Z and thereby forms a frustoconical ledge. A frustoconical portion 48 extends from the inner circumference of the fourth sidewall region 46*b* to the A end to provide the opening to the bore and an inwardly directed lip is formed at the A end to provide a surface for mounting on the mould pattern and produce a notch in the resulting cast feeder neck to facilitate its removal (knock off). In other embodiments, more steps may be provided and the third and/or fourth sidewall regions may be variously inclined or parallel to the bore axis Z.

The circular steps provide the compressible portion in the feeder element 40. A second sidewall region 50 provides a bridge from the compressible portion to first sidewall region (mounting surface) 52. In this embodiment the second sidewall region 50 extends around the bore toward the C end. Hence the third sidewall region 44*a* is contiguous with the second sidewall region 50 and is not contiguous with the first sidewall region 52.

The second sidewall region 50 (and also the entire feeder element 40) is symmetrical about a mirror plane that passes through the bore axis Z from the C end to the D end. This mirror plane is shown by a dashed line in FIGS. 5*b* and 5*c*.

The second sidewall region 50 has a width slightly greater than the collapsible portion (i.e. the diameter of the third sidewall region 44*a*). The length of the collapsible portion (i.e. the diameter of the third sidewall region 44*a*) is approximately 47% of the length (L) of the feeder element 40.

It is clear from the figures that the second sidewall region 50 is non-planar. The second sidewall region 50 flares outward from the third sidewall region 44*a* to the first sidewall region (mounting surface) 52. The collapsible portion is circular and the mounting surface 52 is obround (when viewed along the bore axis). Since the second sidewall region is bridging the differently shaped parts its angle varies around the periphery of the feeder element as shown in the cross-section of the feeder element along the length. The bore axis Z lies in the plane of the section. It can be seen that the second sidewall region 50 makes an angle β at the D (upper) end of the feeder element and an angle γ at the C (lower) end of the feeder element. β (approx 81°) is much greater than γ (10)° measured relative to the bore axis Z. It should be noted that the cross-section of the second sidewall region 50 is linear in this view and in every cross-section in which the bore axis lies.

The maximum height of the second sidewall region (h) is approximately 21% of the height of the feeder element (H).

Figure 6C:
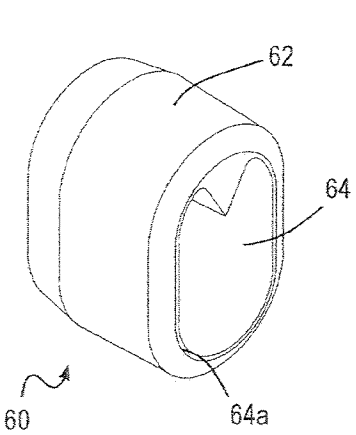
FIGS. 6A-6C show, respectively, end, cross-sectional and perspective views of a feeder sleeve for use in a feeder system in accordance with the invention.
Figure 6B:
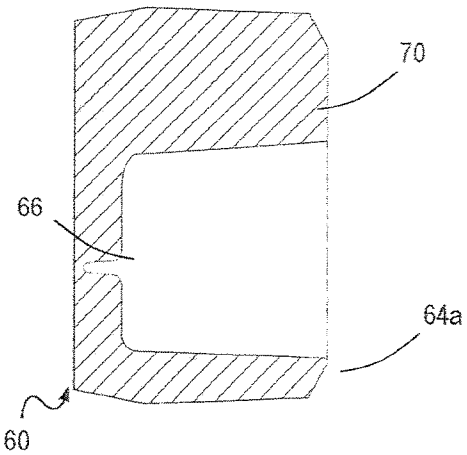
Figure 6A:
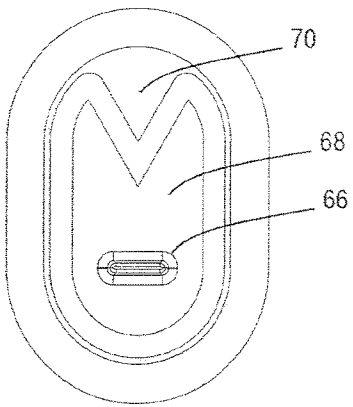

FIG. 6 shows a feeder sleeve 60 suitable for use with the feeder elements of FIGS. 4 and 5. The feeder sleeve 60 is configured for use with vertically parted mould machines and comprises a hollow body 62 which is substantially obround in cross-section and which has an open side 64 configured to mate at the base of the sleeve 64*a* with a mounting surface of a feeder element such as that shown in FIGS. 4 and 5. The open side 64 is therefore substantially obround having a length and a width wherein the length is greater than the width. The base of the sleeve 64*a* is profiled to an angle α to ensure a snug fit with the feeder element having an angled mounting surface. In the embodiment shown, a horizontal recess 66 is provided on a rear wall 68 of the body 62 for location of a support pin (not shown). A spring pin for use with the feeder sleeve comprises a profiled part which mates with the horizontal recess, holding the feeder sleeve and feeder element in an upright position and thereby preventing rotation. Furthermore, a Williams Wedge 70 is provided at the top of the body, extending from the rear wall 68 to the open side 64.

EXAMPLES

In the subsequent examples various feeder systems were tested, comprising combinations of standard and comparative feeder elements, standard and comparative feeder sleeves and feeder systems (elements and sleeves), in accordance with the present invention.

The feeder sleeves were all produced from standard commercial exothermic mixtures, sold by Foseco under the trade names KALMINEX and FEEDEX, and produced using a core-shot process. A typical KALMINEX sleeve has a crush strength of 10-12 kN. A typical FEEDEX feeder sleeve has a crush strength of at least 25 kN.

The standard, comparative and inventive metal feeder elements were manufactured by pressing sheet steel. The metal sheet was cold rolled mild steel (CR1, BS1449) with a thickness of 0.5 mm, unless otherwise stated.

The moulding test was conducted on a DISAMATIC moulding machine (Disa 130). A feeder system was placed on a support pin attached to a horizontal pattern (swing) plate that then swung down 90 degrees so that the pattern plate (face) was in a vertical position. A greensand moulding mixture was then blown (shot) into the rectangular steel chamber using compressed air and then squeezed against the two patterns, which were on the two ends of the chamber. After squeezing, one of the pattern plates is swung back up to open the chamber and the opposite plate pushes the finished mould onto a conveyor. Because the feeder systems were enclosed in the compressed mould, it was necessary to carefully break open each mould to inspect the feeder system. The support pin was centrally situated on the (swing) pattern plate (750×535 mm) either on a boss or a 120×120×20 mm plate attached to the swing plate. The sand shooting pressure was 2 bar and the squeeze plate pressure was either 10 or 15 kPa.

A computer simulation (ABAQUS, manufactured by Abaqus Inc.) was conducted to evaluate the stresses imposed on a feeder system comprising an elongate FEEDEX feeder sleeve with similar dimensions to the sleeve 60 of FIG. 6 and the feeder element 20 of FIG. 4. The advanced finite element analysis software includes a static and dynamic stress-strain resolver which was used for the simulations. The simulation was conducted by fixing the feeder element in the z-axis and then putting the model under a level of strain such that it compresses in the z-axis by a certain distance in a certain time. This puts various parts of the model under different stresses. The model was programmed with the mechanical properties of the sleeve and the feeder element, such that the stresses within the feeder sleeve can be simulated and the metal feeder element compresses. A Young's modulus of 208.5 GPa was used for the feeder element and 539 MPa for the feeder sleeve. The Poisson's ratio of 0.25 was used for both the feeder element and sleeve.

The feeder elements shown in FIGS. 1 (comparative) and 4 (arched second sidewall region) were tested, in conjunction with the feeder sleeves of FIGS. 1 and 6 respectively. The collapsible parts of each feeder element deformed in a similar manner and magnitude. However the feeder element of FIG. 4 caused notably less stress on the feeder sleeve than the comparative feeder element. The areas experiencing the very high stress were the regions at the base of the sleeve along the internal longitudinal straight edges.

The initial simulation results were positive, but not totally conclusive due to some limitations in the simulation tool for this particular application (casting/feeder orientation), hence actual moulding trials were conducted. All of the various feeder elements had an offset bore, and a bore diameter of 18 mm, except for Comp Ex 1 (25 mm). Details are set out below:

| Feeder system | Element type (All with offset bore) | Feeder sleeve type | Pin Mounting on Pattern Plate |
|---|---|---|---|
| Comp Ex 1 | Resin bonded sand feeder element (not compressible). | Elongate but flat mating surface | 20 mm boss |
| Comp Ex 2 | Resin bonded sand feeder element mounted on compressible feeder element (WO2007/141466) | Elongate but flat mating surface | 20 mm boss |
| Comp Ex 3 | 0.5 mm steel as in FIG. 1 | Elongate but flat mating surface | 20 mm boss |
| Comp Ex 4 | 0.5 mm steel as in FIG. 2 | Elongate but flat mating surface | 20 mm boss |
| Ex 1 | 0.5 mm steel as in FIG. 4 (arched) | Elongate and profiled as in FIG. 6 | 20 mm boss |
| Ex 2 | 0.5 mm steel as in FIG. 4 (arched) | Elongate and profiled as in FIG. 6 | 20 mm plate |
| Ex 3 | 0.5 mm steel as in FIG. 4 (arched) | Elongate and profiled as in FIG. 6 | 80 mm boss |

The results are shown below

| Feeder system | Squeeze Plate pressure (kPa) | Swing Plate Position[a] (mm) | Results and Observations |
|---|---|---|---|
| Comp Ex 1 | 10 | 138 | Element broken into pieces.<br>Sleeve damaged.<br>No/poor sand compaction under sleeve |
| Comp Ex 2 | 10 | 138 | Element compressed evenly,<br>Resin bonded sand element fractured.<br>Minor sleeve damage.<br>Good sand compaction under sleeve |
| Comp Ex 3 | 10 | 138 | Element compressed 7 mm, and pushed into sleeve area, particularly at the top i.e. tilted/pushed inwards.<br>Plate buckled (see FIG. 1B).<br>Sleeve damaged and/or separated in parts from the feeder element. |
| Comp Ex 4 | 10 | 138 | Element compressed 8 mm.<br>Plate buckled, but less than Comparative 3.<br>Some sleeve damage and/or separation from the feeder element mounting face. |
| Ex 1 | 10 | 138 | Element compressed 8 mm.<br>Minor buckling (1-2 mm), but no sleeve damage.<br>Very good sand compaction under sleeve. |
| Ex 2 | 15 | 188 | Element compressed 4 mm.<br>Minor buckling (1 mm), but no sleeve damage.<br>Excellent sand compaction under sleeve. |
| Ex 3 | 15 | 231 | Element compressed 19 mm.<br>Very minor deformation (<1 mm), but no sleeve damage or any separation from the mounting surface.<br>Excellent sand compaction under sleeve. |

[a]Distance of the plate to the centre of the mould chamber indicating where the sleeve is located relative to the sand coming in to the mould chamber.

These results demonstrate that none of the comparative feeder elements can be used to successfully feed a casting. Comparative example 1 breaks and there is unsatisfactory sand compaction between the feeder element and the mould. Although the Comparative Ex 2 feeder element collapsed successfully, the resin bonded sand feeder element which links it to the elongate feeder sleeve is damaged. The elongate feeder element of Comparative Ex 3 buckles as shown in FIG. 1, the sleeve becomes damaged and becomes detached from the feeder element in parts. The reinforced comparative feeder element of FIG. 2 also buckles, damaging the sleeve and becoming partly detached.

In contrast, the feeder element of FIG. 4 survives the moulding process and there is no damage to the feeder sleeve. Given the success of Example 1, the trial was repeated with the same feeder element but under different and more demanding moulding conditions. The feeder element still collapses successfully without any damage to the feeder sleeve.

In Example 2, the pin is mounted on a plate rather than a boss, so that there is a reduced thickness of sand at the back between the feeder element and the pattern plate. This results in the sand compressing quicker and being more rigid, and consequently there is less movement and less collapsing of the feeder element. This is despite the squeeze plate pressure being higher than in Example 1.

In Example 3, the pin is mounted on a tall boss so that there is a large volume of sand at the back between the feeder element and the pattern plate. In a similar way to Example 2, a high squeeze plate pressure of 15 kPa was used during moulding. This configuration is a more severe test in that there is scope for greater tilting and movement of the sleeve during the compaction of the sand. On moulding, there was no evidence of sleeve tilting, however, there was a high level of collapsibility of the feeder element (19 mm).

The invention claimed is;

1. An elongate feeder element (20; 40) for use in metal casting, said feeder element (20; 40) having a length, a width and a height, said feeder element (20; 40) comprising:

an A end and an opposite B end measured along the height, and a C end and an opposite D end measured along the length, said A end for mounting on a mould pattern or swing plate and said opposite B end for receiving a feeder sleeve; and a bore between the A and B ends defined by a sidewall comprising a stepped collapsible portion;

said feeder element being compressible in use whereby to reduce the distance between the A and B ends;

wherein said sidewall has a first sidewall region (24;52) defining the B end of the feeder element which serves as a mounting surface for a feeder sleeve in use, and a second sidewall region (38; 50) contiguous with the first sidewall region (24;52), wherein said stepped collapsible portion comprises a series of third sidewall regions (32*a,b,c,d*; 44*a,b*) in the form of concentric rings of decreasing diameter interconnected and integrally formed with a series of fourth sidewall regions (34*a,b,c,d*; 46*a,b*) in the form of concentric annuli of decreasing diameter;

characterised in that said bore has an axis that is offset from the centre of the feeder element along the length towards the C end and said second sidewall region (38;50) is non-planar, contiguous with a third sidewall region and located between the bore axis and the D end.

2. The feeder element of claim 1, wherein the bore axis is offset from the centre of the feeder element by at least 10% of the length.

3. The feeder element of claim 1, wherein the second sidewall region (38; 50) has a height measured in the direction of the bore axis of from 10 to 25% of the height of the feeder element.

4. The feeder element of claim 1, wherein the second sidewall region (38) curves away from the B end, toward the A end and back toward the B end across the width (W) and thereby forms an arch.

5. The feeder element of claim 1, wherein the first sidewall region (24;52) is inclined relative to the bore axis by an angle $\alpha$ where $0<\alpha<90$.

6. The feeder element of claim 5, wherein $\alpha$ is from 50 to 70°.

7. The feeder element of claim 1, wherein the second sidewall region (38;50) is symmetrical about a mirror plane that passes through the bore axis from the C end to the D end.

8. The feeder element of claim 1, wherein the stepped collapsible portion and the second sidewall region (38;50) have substantially the same width.

9. The feeder element of claim 1, wherein the length of the stepped collapsible portion is from 35 to 70% of the length of the feeder element.

10. The feeder element of claim 1, wherein the stepped collapsible portion comprises from 2 to 6 steps.

11. The feeder element of claim 1, wherein the second sidewall region (50) flares outward from the collapsible portion to the first sidewall region (52).

12. The feeder element of claim 1, wherein the second sidewall region (38; 50) makes an angle ($\beta$) relative to the bore axis at the D end of at least 60°.

13. The feeder element of claim 1, wherein the second sidewall region (50) makes an angle ($\gamma$) relative to the bore axis at the C end of at least 5°.

14. The feeder element of claim 1 which is oval, elliptical, rectangular, non-regular polygonal or obround when viewed along the bore axis.

15. The feeder element of claim 1, which is of unitary construction.

16. The feeder element of claim 15, which is press-formed from a single steel sheet of uniform thickness.

17. The feeder element of claim 1, having an initial crush strength of at least 250N.

18. The feeder element of claim 17, having an initial crush strength of less than 7 kN.

19. The feeder element of claim 18 having an initial crush strength of from 1 to 3 kN.

20. The feeder element of claim 1, wherein the bore axis is located substantially centrally with respect to the width of the feeder element and/or the second sidewall region (38; 50).

21. A feeder system for metal casting comprising a feeder element in accordance with claim 1 and a feeder sleeve secured thereto, the feeder sleeve being profiled to match the first sidewall region.

22. The feeder system of claim 21, wherein the feeder sleeve has an open side which is oval, elliptical, square, rectangular, polygonal or obround.

23. The feeder system of claim 21, wherein at least 75% of the feeder sleeve contact area is with the first sidewall region.

24. The feeder system of claim 21, wherein the feeder sleeve has a crush strength of at least 5 kN.

* * * * *